US012435487B2

(12) United States Patent
Bainter

(10) Patent No.: US 12,435,487 B2
(45) Date of Patent: Oct. 7, 2025

(54) IMPLEMENT FOR GRADING ROADS

(71) Applicant: Wesley Allen Bainter, Hoxie, KS (US)

(72) Inventor: Wesley Allen Bainter, Hoxie, KS (US)

( * ) Notice: Subject to any disclaimer, the term of this patent is extended or adjusted under 35 U.S.C. 154(b) by 659 days.

(21) Appl. No.: 17/749,931

(22) Filed: May 20, 2022

(65) Prior Publication Data

US 2022/0372728 A1 Nov. 24, 2022

Related U.S. Application Data

(60) Provisional application No. 63/191,487, filed on May 21, 2021.

(51) Int. Cl.
*E02F 3/76* (2006.01)

(52) U.S. Cl.
CPC ..... *E02F 3/7668* (2013.01)

(58) Field of Classification Search
CPC ..... E02F 3/7668; E02F 3/7686
USPC ..... 172/799.5; 404/85
See application file for complete search history.

(56) References Cited

U.S. PATENT DOCUMENTS 1,133,094 A 3/1915 Bunker
1,196,965 A * 9/1916 Moats et al. ..... E02F 3/7668 172/793
2,089,730 A 8/1937 Brown et al.
2,186,658 A 1/1940 Schunemann
2,635,888 A 4/1953 Bailiff
2,818,664 A 1/1958 Bond
2,866,281 A 12/1958 Breaux
2,881,541 A 4/1959 Darnell
3,126,655 A 3/1964 Fischer
3,195,249 A 7/1965 Collins
3,444,937 A 5/1969 Page et al.
3,486,567 A 12/1969 Weaver
5,289,880 A 3/1994 Barto
5,890,564 A 4/1999 Kerplash, Sr.
6,119,792 A 9/2000 Almer
6,615,929 B2 9/2003 Heckendorf
6,851,484 B2 2/2005 Klompein
6,904,979 B1 * 6/2005 Confoey ..... E02F 3/7604 172/799.5
7,600,576 B2 10/2009 Gayer
10,119,243 B2 11/2018 Chern
(Continued)

OTHER PUBLICATIONS

International Search Report for PCT/US2022/030327 dated Aug. 16, 2022.

*Primary Examiner* — Gary S Hartmann

(57) ABSTRACT

A road drag implement includes a frame, a hitch assembly, rear wheels and a two grading blades. The frame is supported by the rear wheels and the hitch assembly. The rear wheels and the hitch assembly have articulating support structures that are able to be controllably positioned between a raised transport positions and lowered working positions. A first blade assembly and a second blade assembly are pivotably mounted to the frame. The first blade assembly is in a forward position on the right side of the frame and the second blade assembly is behind the first blade assembly on the left side of the frame. Actuators connect between the frame and each respective blade assembly which are able rotate the blade assemblies between a first retracted position for transport and a second extended position for road work.

4 Claims, 4 Drawing Sheets

(56) References Cited

U.S. PATENT DOCUMENTS

| | | | | |
|---|---|---|---|---|
| 11,905,676 | B2 * | 2/2024 | Hrabarchuk | E02F 3/7668 |
| 2005/0173138 | A1 | 8/2005 | Taylor et al. | |

* cited by examiner

IMPLEMENT FOR GRADING ROADS

CROSS REFERENCES TO RELATED APPLICATIONS

This application claims the benefit of U.S. Provisional Patent Application No. 63/191,487 filed on May 21, 2021, which is incorporated herein by reference as if repeated verbatim hereinafter.

FIELD

This invention relates to an implement that is adapted for grading and smoothing roads having surfaces consisting of granular materials such as dirt or gravel.

BACKGROUND

Road graders have long been used for smoothing and grading road surfaces. A typical road grader is shown in FIG. 1 of U.S. Pat. No. 3,552,498 by Stauber. With the exception Stauber's novel blade mounting means, the general arrangement of the road grader shown in FIG. 1 of Stauber is typical of such prior art road graders. As can be seen by referring to FIG. 1 of U.S. Pat. No. 3,552,498, such road graders include a frame, a forward set of wheels for steering, a rear set of drive wheels, a control cab and a depending blade that can be lowered and raised and oriented at an angle with respect to an upright axis at a level suitable for grading the granular material of the surface of a gravel or dirt road. Typical prior art graders are highly specialized pieces of equipment that may be employed to accomplish a variety of surface conditioning tasks. However, in the case of a typical prior art grader, the placement and orientation of the grader blade and the overall operation of a grader are matters that require substantial skill and experience. Accordingly, significant experience and skill is needed when smoothing and grading an existing gravel road or dirt road. (Hereinafter, a road that has a surface consisting of dirt or a granular material, or a surface that includes gravel as a "gravel road" or "gravel road surface".) The applicant has observed that such a high degree of experience and skill may not always be available when a typical prior art grader is employed for smoothing and re-grading a gravel road surfaces in remote rural areas. The regrading of such road surfaces becomes particularly desirable when the road has become rutted and when "wash boarding" has developed in the surface of the road. Moreover, gravel tends to migrate from the center of a road to its edges where the material will eventually be lost and wasted and eventually obstruct the side ditches that are needed to convey rain water. Accordingly, what is needed is a grading implement that can be easily towed down a segment of gravel road and that is able to quickly and easily re-grade the surface to redistribute gravel and to eliminate unwanted surface irregularities such as ruts and wash boarding.

SUMMARY

The above noted need is addressed by a road drag (or road grader) implement that includes a frame and at least two grading blades. The road drag implement is arranged to be able to deploy the two grading blades across a width that is between one and three feet in excess of half the width of a typical rural gravel road. In this example, the frame is supported by rear wheels and presents a forward hitch that is able to be connected to a farm tractor. The rear wheels and the hitch have articulating support structures that are able to be repositioned between a transport position in which the frame is raised and a working position in which the frame is lowered for road work. At least a first blade assembly and a second blade assembly are pivotably mounted to the frame. The first blade assembly is mounted to the frame toward the forward end of the frame and preferably on the right side of the frame. The second blade assembly is mounted to the frame toward the rear of the frame and generally on the left side of the frame. A first blade actuator connects between the frame and the first blade assembly and is operable for pivoting the first blade assembly between a first retracted position in which the first blade is generally within the outer margins of the frame and a second operating position in which the right end of the blade extends to the right of the frame and the left end of the blade preferably extends past the transverse center of the frame. A second blade actuator connects between the frame and the second blade assembly and is operable for pivoting the first blade assembly between a first retracted position in which the second blade is generally within the outer margins of the frame and a second operating position in which the left end of the blade extends to the left of the frame and the right end of the blade extends toward the transverse center of the frame and preferably overlaps with the left end of the first blade assembly.

DETAILED DESCRIPTION

Figure 1:
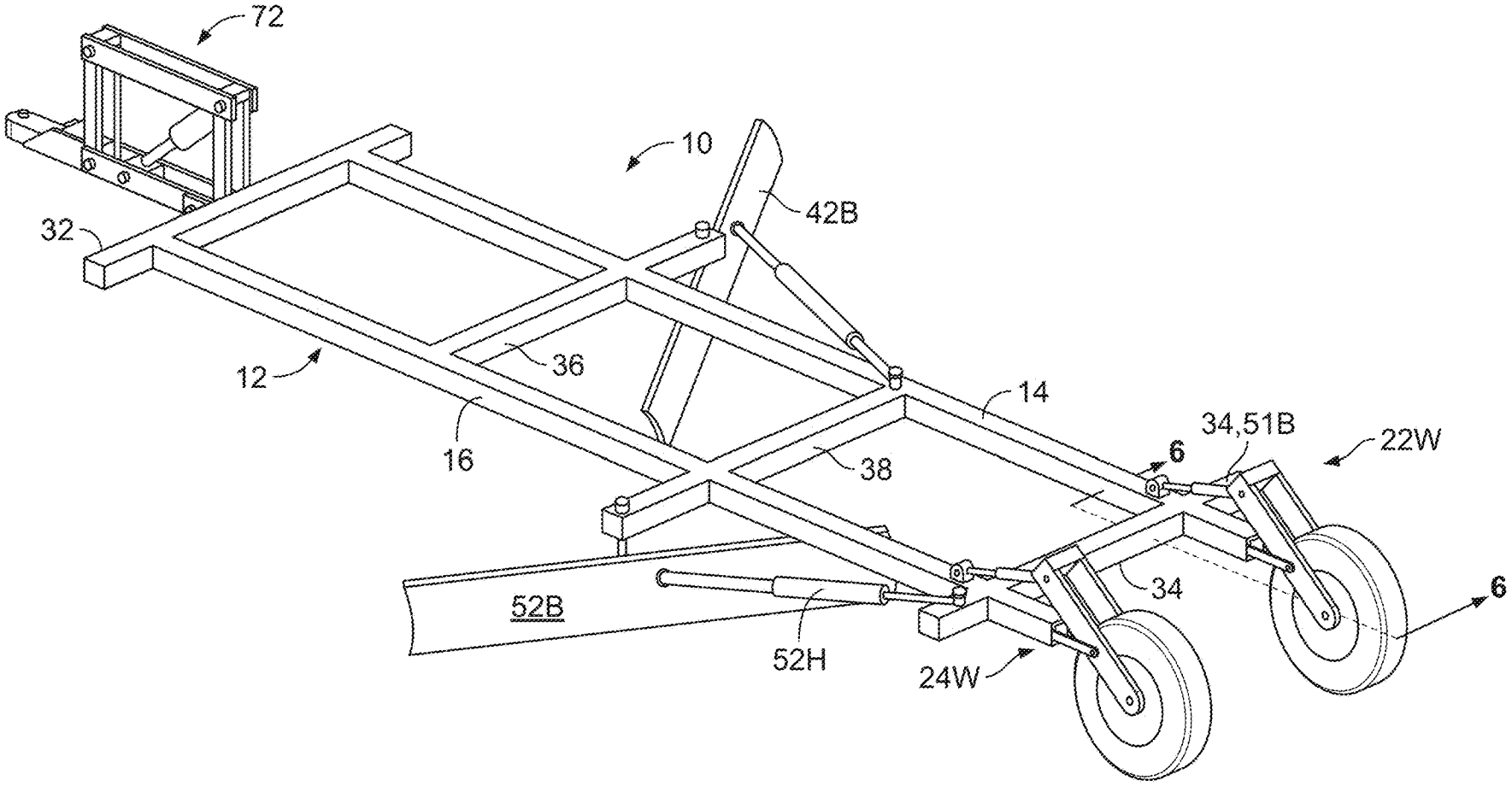
FIG. 1 is perspective view of an embodiment of a road drag implement for grading roads.
Figure 2:
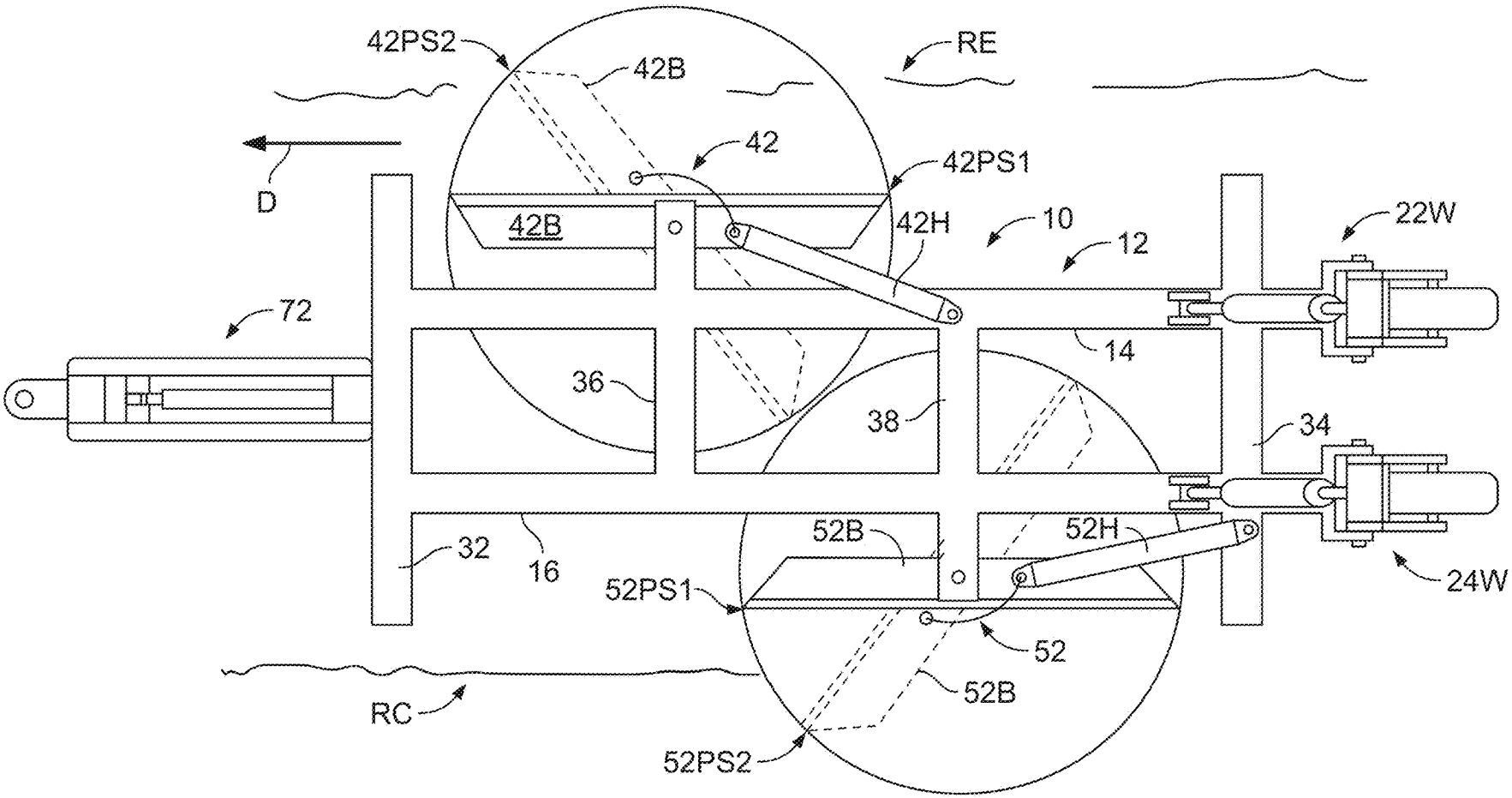
FIG. 2 is a plan view of an embodiment of a road drag implement for grading roads.

Referring to the figures, FIGS. 1 and 2 provide a perspective view and a plan view of a road drag implement 10. In this example, as is shown in FIGS. 1 and 2, road drag implement 10 includes a frame 12 that is supported by right and left wheel assemblies 22W, 24W, respectively, which include wheels 22WH and 24WH, respectively, for enabling rolling movement along a road surface. In this example, grading implement 10 also includes a forward blade assembly 42 and a rear blade assembly 52. Also in this example, grading implement 10 includes a hitch assembly 72 that is mounted to the forward end of frame 12.

As can be seen in FIGS. 1 and 2, in this example, frame 12 of road drag implement 10 includes two parallel longitudinal members 14 and 16, a forward transverse member 32, a rear transverse member 34, a forward blade support member 36 and a rear blade support member 38. A direction of travel arrow D indicates the direction of travel or operation for road drag implement 10.

As can be further seen in FIGS. 1 and 2, forward blade assembly 42 includes a forward blade 42B that is pivotably mounted to forward grading blade support member 36 for rotation about a generally upright pivot axis 42P between a first retracted transport position (indicated by 42PS1) and a second extended working position (indicated by 42PS2). The first retracted transport position places grader blade 42B within the margins of frame 12. The second, extended, working position, places the right end of grader blade 42B forward and to the right of pivot axis 42P as well as outside the margins of frame 12 and also places the left end of grader blade 42B slightly to the right of the center of frame 12 and rearward of pivot axis 42P. The movement of grader blade 42B between the first retracted position and the second extended position is actuated by an actuator 42H, which, in this example, is a hydraulic cylinder which moves between a first corresponding retraced position and a second corresponding extended position as shown in FIG. 2.

Rear blade assembly 52 includes a rear blade 52B that is pivotably mounted to rear grading blade support member 38 for rotation about a generally upright pivot axis 52P between a first retracted transport position (indicated by 52PS1) and a second extended working position (indicated by 52PS2). The first retracted transport position places grader blade 52B within the margins of frame 12. The second, extended, working position, places the right end of grader blade 52B behind and to the right of pivot axis 52P as well as slightly to the right of the center line of frame 12 and also places the left end of grader blade 42B well beyond the left side of frame 12 and forward of pivot axis 42P. The movement of grader blade 52B between the first retracted position and the second extended position is actuated by an actuator 52H, which, in this example, is a hydraulic cylinder which moves between a first corresponding retraced position and a second corresponding extended position as shown in FIG. 2.

Accordingly, as can be understood by referring to FIGS. 1 and 2, both grader blades, 42B and 52B, can stowed in a retracted position suitable for transport and rotated to their respective working positions. When in the second working positions, grader blades 42B and 52B are arranged for directing gravel that typically accumulates on the right side of a gravel road toward the center of the portion of the road being traversed and redistributing that gravel across that portion of road as well as smoothing to eliminate ruts and wash-boarding. It should be noted that preferably, in this example, grader blades 42B and 52B may be arranged on grader blade assemblies 42 and 52 to be removable and replaceable. Blades 42B and 52B may be of the type that have continuous straight lower edges or may be of a type having a plurality of teeth projecting from the lower edge.

Figure 6:
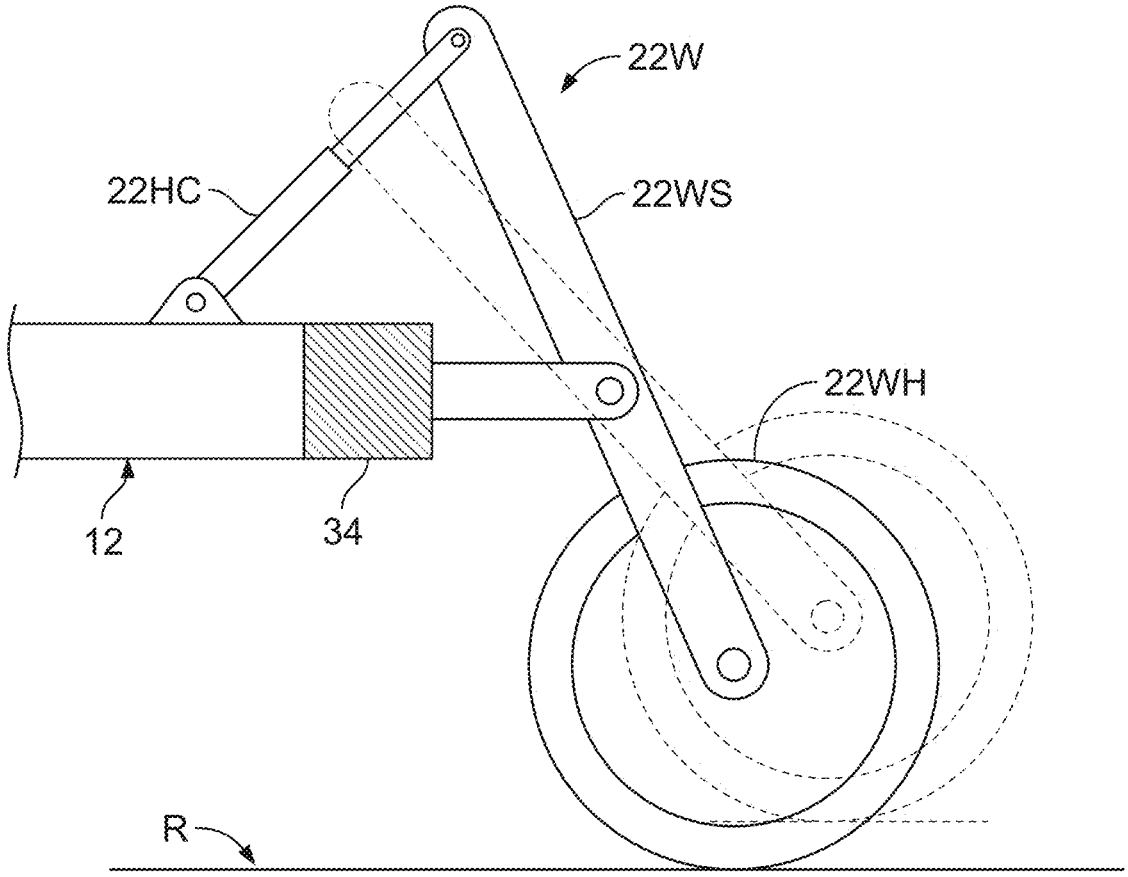
FIG. 6 is a side view of a wheel assembly that supports the rear end of the frame of the road drag implement.

As noted above, and as shown in FIG. 6, right and left wheel assemblies 22W and 24W are preferably identical wheel assemblies. Wheel assemblies 22W and 24W support wheels 22WH and 24WH respectively and are arranged for preferably simultaneous motion between a raised position and a lowered position with respect to frame 12. The raised position results in frame 12 being lowered into a working position. While the lowered position raises frame 12 into a transport position. Those skilled in the art will readily appreciate that any one of a number of pivoting support structures and actuators may be adopted for enabling the above-described movement of wheel assemblies 22W and 24W. The structure shown in FIG. 6 is an example of how wheels 22WH may be arranged to articulate between a position that raises frame 12 (and implement 10) for transport. A wheel strut 22WS provides a rotatable mount for wheel 22WH. The solid line position shown in FIG. 6 is the one in which wheel 22WH is lowered for raising frame 12 and implement 10 for transport. The phantom line show wheel strut 22WS in a position suitable for raising wheel 22WH thereby lowering frame 12 into a position suitable for bringing the grader blades into contact with road R.

Figure 4:
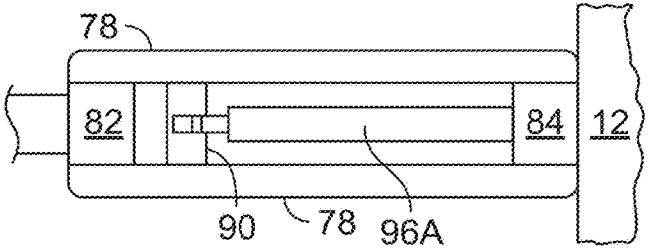
FIG. 4 is a top view of the forward hitch structure taken from plane A-A of FIG. 2.
Figure 3:
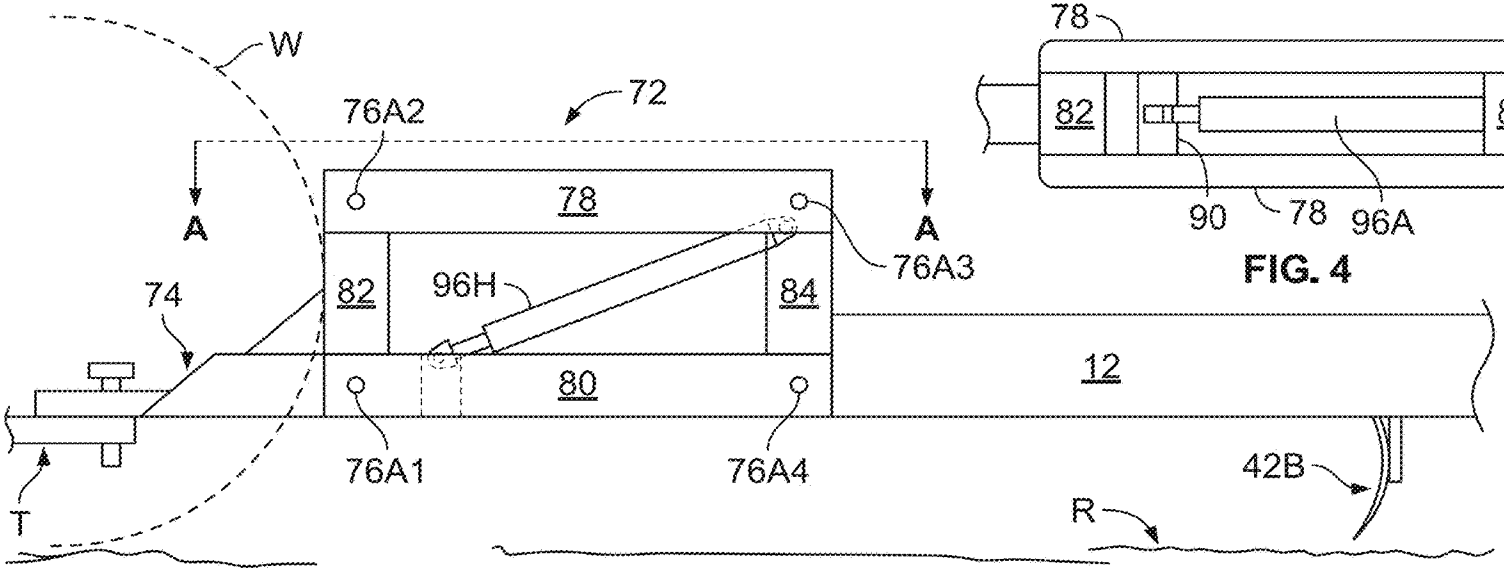
FIG. 3 is a side view of the forward hitch structure of an embodiment of a road drag implement showing the hitch structure in the first, lowered working position.
Figure 5:
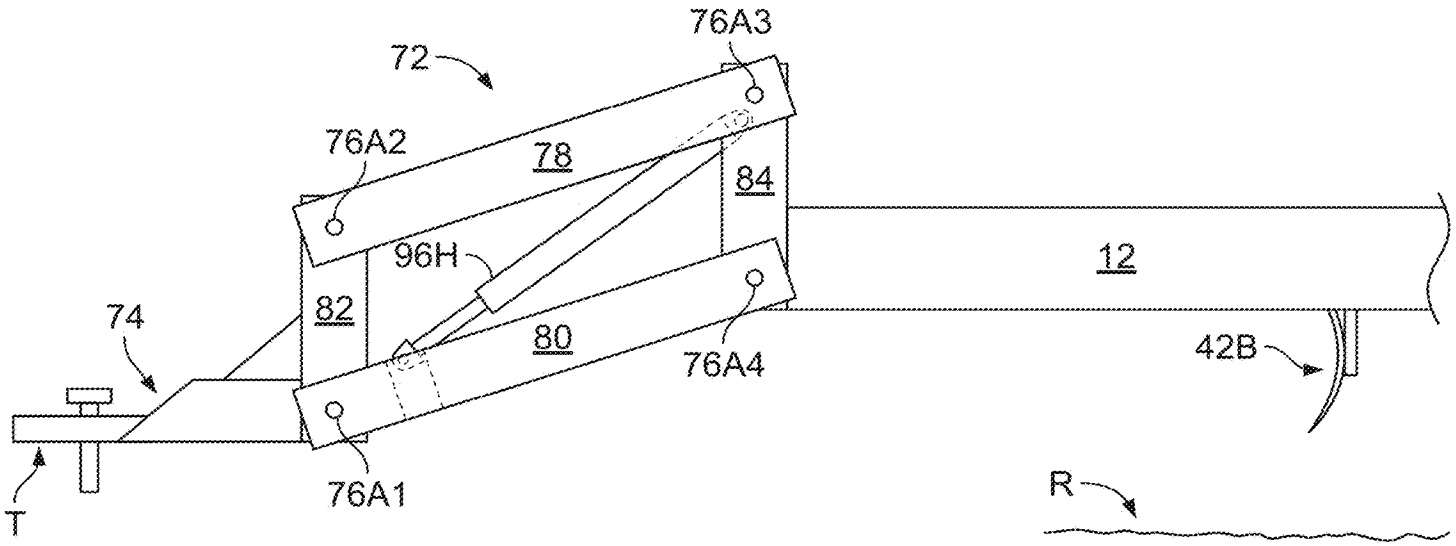
FIG. 5 is a second side view of the forward hitch structure of an embodiment of a road drag implement showing the hitch structure in the second, raised transport position.

As can be seen in FIG. 3-5, hitch assembly 72 is mounted to the forward end of frame 12. Hitch assembly 72 is arranged to translate between a first lowered working position as shown in FIG. 2 and a second raised, transport position as shown in FIG. 5. As can be seen in FIGS. 3 and 5, a hitch coupling unit 74 is fixed to the forward end of hitch assembly 72. Hitch coupling unit 74 may be of any suitable configuration for mounting to a typical tractor hitch support T. Hitch coupling unit 74 must be able to carry substantial loads that would be at least approximately 50% the weight of the road drag implement 10. In FIG. 3, an outline of tractor wheel W is indicated to provide a general reference as to the general size and scale of the tractor wheels of the tractor that would be typically employed to tow road drag implement 10.

Employing a tractor that has large rear tractor wheels W as shown in FIG. 3 is an important aspect for the proper function of road drag implement 10. Preferably, tractor wheel W (shown in phantom in FIG. 3) is sufficiently large that it tends to not react to wash-boarding that may be present in the road surface or at least react to a sufficiently lesser degree as would a vehicle wheel of normal size as would be used on a trailer or an implement. This is an important consideration because if the wheel W is sufficiently large, then the front end of frame 12 and therefore blade 42B would not move up and down in response to the undulations of a washboard gravel surface, or would do so to a much lesser degree than would be the case if the front end of frame 12 was supported by wheels of normal size. Accordingly, relatively small front wheels of normal size would ride up and down on washboard undulations and cause blade 42B to also move up and down. This problem does not occur with wheels 22WH (shown in FIG. 6) at the rear end of frame 12, because those wheels are behind blades 42B and 52B and are therefore rolling on a surface that has been smoothed by blades 42B and 52B.

As can be seen in FIGS. 3 and 5, hitch assembly 72 includes a parallelogram frame box 76 that includes top members 78, bottom members 80, a front member 82 and a rear member 84. As can be seen in FIGS. 3-5, frame box 76 is an articulated parallelogram structure that is oriented in an upright and longitudinal manner. Hitch coupling unit 74 is fixed to front member 82 of frame box 76 and rear member 84 of frame box 76 is fixed to forward end of frame 12. Frame box 76 is connected together by pivot joints 76A1, 76A2, 76A3 and 76A4 which are all arranged so that the members that connect at those joints are able to pivot with respect to each other on axes of rotation that are oriented in a transverse and horizontal manner. As can be seen in FIGS. 3-5, an actuator 96H is mounted so that it connects in a pivoting manner to a strut 90 (shown in FIG. 4) and in a pivoting manner to rear member 84. In this example, actuator 96H is a hydraulic cylinder. As shown in FIG. 4, strut 90 is fixed between the forward ends of bottom members 80. Accordingly, when actuator 96H is extended, pivot joints 76A1 and 76A3 are pushed away from each other so that frame box is in an elongated parallelogram condition as shown in FIG. 5. This causes the front end of frame 12 to be raised into transport position in which blade 42B is raised so that it is well above road R in a manner that is suitable for transport. And when actuator 96H is contracted, pivot axes 76A1 and 76A3 are pulled toward each other from the position shown in FIG. 5, so that, in this example, frame box is in a rectangular configuration as shown in FIG. 3. This causes the front end of frame 12 to be lowered into a working position so that blade 42B is able to be in working contact with the surface of road R.

The operation of road grading implement 10 would be relatively easy for even a moderately skilled operator who would have sufficient skills for operating a vehicle and a trailer down the center of a right side portion of a gravel road (in localities where vehicles are operated on the driver's right side). Preferably, blades 42B and 52B would be arranged generally as shown in FIGS. 1, 2, 3 and 5 (in the 42PS2 and 52PS2 positions indicated in FIG. 1). As shown in FIG. 2, road drag implement 10 would be positioned so that the right edge of blade 42B extends slightly past road edge RE and so that the left edge of blade 52B extends slightly past road centerline RC. And further, wheel assemblies 22W and 24W as well as hitch assembly 72 need to be configured so that both blades 42B and 52B are brought into position as shown in FIG. 3 for blade 42B. Dragging road drag implement 10 when in this configuration should transfer gravel piled at the road edge RE back toward the center and result in smoothing of wash-boarding as wheels 22WH and 24WH roll on a relatively smooth surface. If an oncoming vehicle is encountered or if implement 10 needs to be transported, frame 12 can be raised as described above and blades 42B and 52B can be swung into the retracted, transport positions 42PS1 and 52PS1 as shown with the solid lines in FIG. 2.

The skilled reader will readily appreciate that, in this example, a controllable hydraulic system of a type well known in the art would be needed to (a) extend and retract grader blades 42B and 52B between retracted and extended positions shown in FIG. 2, and (b) raise and lower frame 12 between a transport and working position as shown in FIGS. 3, 5 and 6. Generally and conventionally, it would be preferred if a first controllable hydraulic circuit was used for extending and retracting hydraulic cylinders 42H and 52H for actuating blades 42H and 52H respectively. The first hydraulic circuit could be arranged for either separate or simultaneous actuation. Separate actuation might be preferred if it would be advantageous for an operator to have, for example, full extension of a grading blade on one side and less than full extension of the grading blade on the opposite side. A similar approach could also be adopted for a second hydraulic circuit that would control the raising and lowering of the frame. It may be advantageous to actuate hydraulic cylinder 96C in hitch assembly 72 simultaneously with hydraulic cylinder 22HC in rear wheel assembly 22W, or it may be advantageous to be able to selectively actuate cylinders 96C and 22HC, on occasion, if the operator desires to make separate elevation adjustments in the front and the rear of implement 10.

As can be understood from the above description, road drag implement 10 provides a highly effective and efficient means for smoothing and grading road surfaces of granular material. As is noted above, after a set-up operation is completed, an operator merely needs to drag road drag implement 10 down a gravel road that has been selected for grading in order to accomplish an optimal redistribution and smoothing of the gravel of the road being worked.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A road drag implement for smoothing gravel roads, comprising:

(a) a frame having a front end and a rear end, (b) a first right side grading blade that is rotatably mounted to the frame for rotation about a upright axis at a pivot location that is located on the right side of the frame, a first blade actuator connecting between the frame and the right side grading blade that is controllable for rotating the blade between a first retracted transport position wherein the right side grading blade is retracted so that the right side grading blade generally does not extend beyond the right side of the frame and a second extended working position wherein the right end of the right side grading blade extends beyond the right side of the frame and forward of and to the right of the pivot location for the first right side grading blade and wherein the left end of the right side grading blade extends behind and to the left of the pivot location for the right side grading blade, (c) a second left side grading blade that is rotatably mounted to the frame for rotation about a upright axis at a pivot location that is located on the left side of the frame and spaced behind the pivot location of the first right side grading blade, a second actuator connecting between the frame and the second left side grading blade that is controllable for rotating the second left side grading blade between a first retracted transport position wherein the left side grading blade is retracted so that the left side grading blade generally does not extend beyond the left side of the frame and a second extended working position wherein the left end of the left side grading blade extends beyond the left side of the frame and forward of and to the left of the pivot location for the second left side grading blade and wherein the right end of the second left side grading blade extends behind and to the right of the pivot location for the second left side grading blade and to a location that is behind the left end of the first right side grading blade, (d) a wheel assembly including ground engaging wheels, the wheel assembly being pivotably mounted to the rear end of the frame, the wheel assembly including an actuator that extends between the frame and the wheel assembly for controllable movement between a first wheel assembly position wherein the frame is elevated for transport and a second wheel assembly position wherein the frame is lowered into a working position suitable for bringing the grading blades in contact with a road surface, and, (e) a hitch assembly that is mounted to the forward end of the frame and that is adapted to connect with a tractor hitch, the hitch assembly being arranged as a parallelogram structure that is oriented in an upright and longitudinal manner in an upright and longitudinal plane, the hitch assembly including a forward member and a rear member as well as a top member and a bottom member, the top and bottom members being pivotally connected to the forward and rear members respectively for pivoting motion about axes that are normal to the upright longitudinal plane of orientation of the hitch assembly, the hitch assembly further including an actuator that is connected between one of the top and bottom members and one of the forward and rear members at spaced apart locations and that is movable between a retracted position and an extended position such that the rear member is able to be translated between an elevated position for raising the frame for transport of the road drag implement, and a lowered position suitable for bringing the road drag implement blades in contact with a road surface for the grading of the road surface.

2. The road drag implement of claim 1, wherein;

the actuators of the wheel assembly and the hitch assembly are hydraulic cylinders.

3. The road drag implement of claim 2, wherein;

the hydraulic cylinders of the wheel assembly and the hitch assembly are connected together in a hydraulic system that is controllable for simultaneous, coordinated raising and lowering of the front end and the rear end of the frame.

4. The road drag implement of claim 2, wherein;

the hydraulic cylinders of the wheel assembly and the hitch assembly are connected together in a hydraulic system that is operable to cause simultaneous, coordinated raising and lowering of the front end and the rear end of the frame or is alternatively operable to select a mode in which the front end of the frame is raised or lowered or to select a mode wherein the rear end of the frame is raised or lowered.

* * * * *